United States Patent [19]

Prochnow et al.

[11] 4,135,449

[45] Jan. 23, 1979

[54] PROJECTILE FOR ATTACKING SMALL TARGETS

[75] Inventors: Jürgen Prochnow, Düsseldorf; Wolf Trommsdorff, Porz-Grengel, both of Fed. Rep. of Germany

[73] Assignees: Rheinmetall GmbH, Düsseldorf; Deutsche Forschungs- und Versuchsanstalt für Luft- und Raumfahrt e.V., Porz-Wahn, both of Fed. Rep. of Germany

[21] Appl. No.: 589,790

[22] Filed: Jun. 20, 1975

[51] Int. Cl.[2] ..... F42B 11/14

[52] U.S. Cl. ..... 102/52; 137/15.1; 60/270 R

[58] Field of Search ..... 102/52, 92.1, 92.2, 102/93, 92.6; 60/270; 137/15.1, 15.2

[56] References Cited

U.S. PATENT DOCUMENTS

| | | | |
|---|---|---|---|
| 2,684,629 | 7/1954 | Nordfors | 60/244 |
| 2,931,167 | 4/1960 | Leduc | 137/15.1 |
| 2,989,922 | 6/1961 | Greenwood et al. | 102/49.7 |
| 3,903,802 | 9/1975 | Squiers | 60/270 S |

FOREIGN PATENT DOCUMENTS

| | | | |
|---|---|---|---|
| 1033299 | 4/1953 | France | 102/49.8 |

*Primary Examiner*—Samuel Feinberg
*Attorney, Agent, or Firm*—Montague & Ross

[57] ABSTRACT

A projectile fired from a gun barrel, aimed in straight flight upon a small target, has a massive armor-piercing body spacedly surrounded by a sleeve which defines with its outer surface a ring channel that may also serve as a combustion chamber for generating additional thrust. The sleeve, whose cylindrical outer periphery provides guidance in the gun barrel, is axially divided into a rear portion rigid with the massive body and a relatively slidable front portion. In an initial forward position of this front portion, an annular shutter mounted on its inner surface obstructs the ring channel by engaging an annular shoulder on the body, the sleeve then effectively acting as a sabot which blocks the escape of combustion gases from the gun blast. Upon leaving the gun barrel, the slidable front portion is forced back by the pressure of ambient air and unblocks the ring channel while simultaneously venting that channel to the surrounding atmosphere through slots provided in this portion forwardly of its valve ring.

6 Claims, 2 Drawing Figures

PROJECTILE FOR ATTACKING SMALL TARGETS

FIELD OF THE INVENTION

Our present invention relates to a projectile to be fired from a gun barrel and to be aimed in straight flight upon a small target such as, for example, an armored tank.

BACKGROUND OF THE INVENTION

Conventional anti-tank projectiles are designed as subcaliber shells which are provided with a sabot that is discarded in flight, not without danger to friendly personnel nearby.

It has already been proposed to provide projectiles of this type with a casing within which a warhead is axially slidable between a forward and a rearward position (see U.S. Pat. No. 2,684,629); in its forward position, which the warhead occupies during firing, an annular channel formed between it and the surrounding casing is blocked to prevent the escape of combustion gases generated by the gun blast. In flight, the resistance of the ambient air represses the warhead into its rearward position in which air entering the channel from the front reaches a charge in a combustion chamber forming part of that channel. U.S. Pat. No. 2,989,922 discloses a similar arrangement wherein, however, the warhead on firing closes the rear end of the channel which is reopened in flight by the relative motion of the warhead and the casing to facilitate the discharge of thrust gases developed in the combustion chamber.

OBJECT OF THE INVENTION

The object of our present invention is to provide an improved projectile which can be pinpointed with high initial velocity at a target, with or without additional thrust generated in flight.

SUMMARY OF THE INVENTION

We realize this object, in accordance with our present invention, by providing an armor-piercing central body spacedly surrounded by a sleeve which is axially divided into a rear portion rigid with the central body and a front portion slidable with reference thereto, the latter portion carrying on its inner peripheral surface an annular shutter engaging in its forward position a coacting annular formation on the central body to obstruct the ring channel formed between the sleeve and that body. Upon the firing of the projectile from a gun barrel, the pressure of ambient air acting on the annular shutter represses the front portion of the sleeve so as to unblock the channel for the passage of air therethrough.

BRIEF DESCRIPTION OF THE DRAWING

The above and other features of our invention will now be described in detail with reference to the accompanying drawing in which.

SPECIFIC DESCRIPTION

Figure 2:
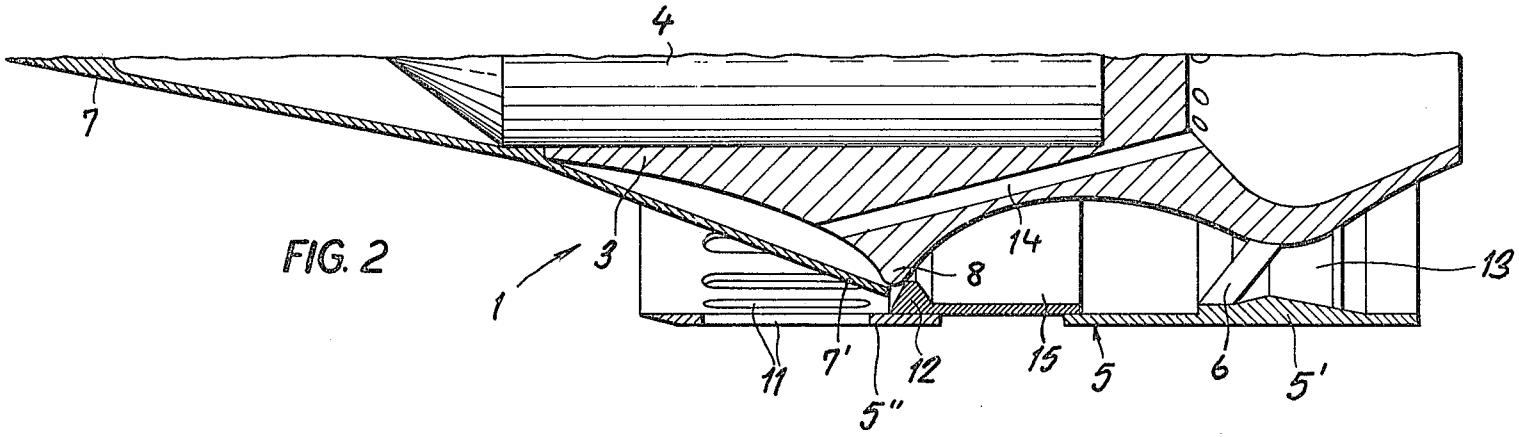

The projectile 1 shown in the drawing comprises an armor-piercing central body, in the form of a heavy metallic core 4 surrounded by a carrier 3, defining with a surrounding casing or sleeve 5 an open-ended annular channel or diffuser 2 terminating at the rear in an expansion chamber 13. Sleeve 5 is axially divided into a rear portion 5' and a front portion 5'', portion 5' being fixedly secured to the central body 3, 4 by means of stays 6. Portions 5' and 5'' have cylindrical surfaces of like diameter fitting into a nonillustrated gun barrel. Front portion 5'' has a tubular rearward extension 15 which is telescopically received in rear portion 5' and is integral with an annular shutter in the form of an inner peripheral rib 12 obstructing the channel 2 in the firing position of FIG. 2 by engaging an annular shoulder 8 of carrier 3, rib 12 being held in this blocking position relative to the more massive central body 3, 4 by the gases from the gun blast. These propulsion gases, therefore, cannot escape around the projectile so that sleeve 5 effectively plays the role of the conventional sabot. In flight, the relatively mobile sleeve portion 5'' is rearwardly repressed by the encountered air volume which enters the diffuser 2 and exits at the expansion chamber 13. Shoulder 8 separates a fore part and an aft part of carrier 3, both of smaller diameter, from each other.

A generally frustoconical, forwardly pointed jacket 7 surrounds the central body 3, 4 and has a skirt 7' defining with the fore part of carrier 3 an annular clearance 10 communicating via a narrow peripheral gap 9 with channel 2 forwardly of rib 12. A shroud 16 on the aft part of carrier 3 surrounds an axial recess 17 connected via a set of generally axial bores 14 with the clearance 10 whereby boundary-layer air from the surface of skirt 7' is drawn off regardless of the position of rib 12.

Figure 1:
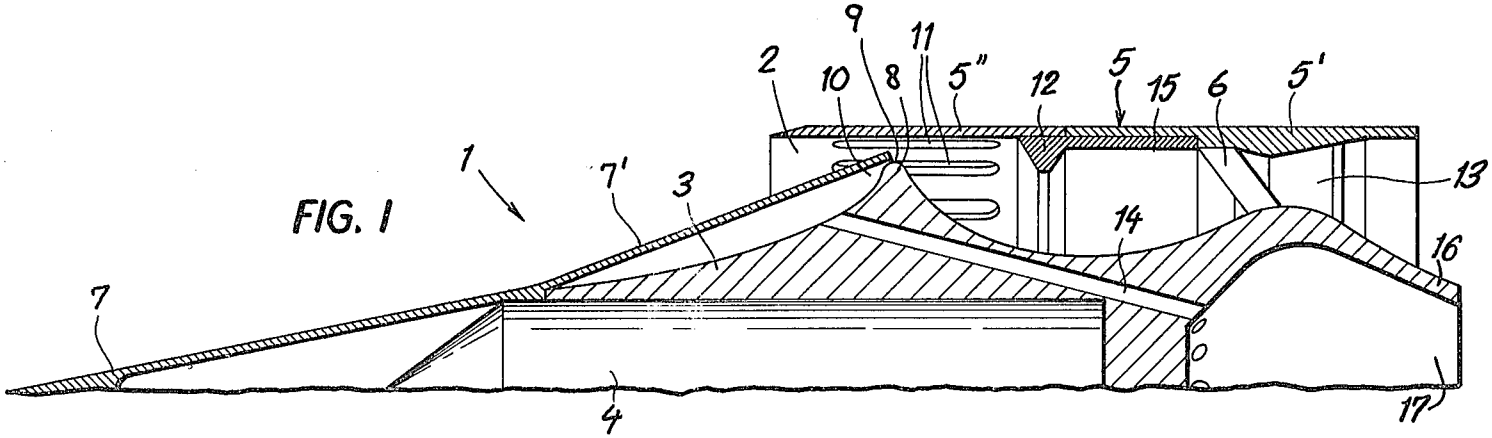
FIGS. 1 and 2 show upper and lower halves, respectively, of a projectile according to our invention, FIG. 2 representing the firing position and FIG. 1 illustrating the in-flight position.

Front portion 5'' of sleeve 5 is provided with a multiplicity of slots 11 which in the retracted position of FIG. 1 vent a ventral section of channel 2 (surrounded by tubular extension 15) to the atmosphere; this central section may contain a combustible charge to generate additional thrust in flight.

Thanks to the rearwardly diverging shape of jacket 7 and to the air passages 2 and 14 provided in the projectile, its air resistance is small compared with that of shells having an ogival profile.

We claim:

1. A projectile to be fired from a gun barrel, comprising:

an armor-piercing body centered on an axis;

a sleeve spacedly surrounding said body and defining therewith a forwardly and rearwardly open ring channel, said sleeve being axially divided into a rear portion rigid with said body and a front portion slidable with reference thereto; and annular shutter means on an inner peripheral surface of said front portion engaging a coacting annular formation on said body in a forward position of said front portion for obstructing said ring channel upon the firing of the projectile from a gun barrel surrounding said sleeve, said front portion being repressible in flight by ambient-air pressure on said shutter means into a rearward position in which said ring channel is unblocked for the passage of air therethrough.

2. A projectile as defined in claim 1 wherein said front and rear portions have cylindrical outer surfaces of like diameter centered on said axis.

3. A projectile as defined in claim 2 wherein said front portion is provided with a tubular rearward extension telescopically received in said rear portion, said shutter means being a rib integral with said extension.

4. A projectile as defined in claim 1 wherein said front portion is provided with venting slots forwardly of said shutter means, said venting slots extending across said coacting formation in said rearward position.

5. A projectile as defined in claim 1 wherein said coacting formation is a shoulder separating smaller-diameter fore and aft parts of said body, further comprising a generally frustoconical forwardly pointed jacket surrounding said fore part and forming therewith an annular clearance terminating at said shoulder, said aft part being provided with generally axially extending bores communicating with said clearance, said jacket defining with said shoulder a narrow peripheral gap within said ring channel for enabling a boundary layer of air to pass through said bores to the rear of said body.

6. A projectile as defined in claim 5 wherein said aft part has an axial recess surrounded by a shroud, said bores terminating within said recess.

* * * * *